US006752704B1

(12) United States Patent
Lin

(10) Patent No.: US 6,752,704 B1
(45) Date of Patent: Jun. 22, 2004

(54) GRINDER WITH EASILY INSTALLABLE/ DETACHABLE GRINDING DISC

(75) Inventor: Freddy Lin, Taichung (TW)

(73) Assignee: Gison Machinery Co., Ltd., Taichung Hsien (TW)

( * ) Notice: Subject to any disclaimer, the term of this patent is extended or adjusted under 35 U.S.C. 154(b) by 0 days.

(21) Appl. No.: 10/408,311

(22) Filed: Apr. 8, 2003

(51) Int. Cl.[7] ..... B24B 23/00
(52) U.S. Cl. ..... 451/295; 451/357
(58) Field of Search ..... 451/359, 295, 451/353, 344; 279/2.19, 66, 110, 904

(56) References Cited

U.S. PATENT DOCUMENTS 949,031 A * 2/1910 Borden ..... 279/114
4,041,612 A * 8/1977 Skubic ..... 279/114
4,663,203 A * 5/1987 Coffin, Sr. ..... 428/12
5,518,441 A * 5/1996 Valentini ..... 451/357
6,257,970 B1 * 7/2001 Huber ..... 451/357
6,485,360 B1 * 11/2002 Hutchins ..... 451/357

* cited by examiner

*Primary Examiner*—Robert A. Rose
(74) *Attorney, Agent, or Firm*—Troxell Law Office PLLC

(57) ABSTRACT

A grinder with easily installable/detachable grinding disc, including: a main body in which a driving unit is disposed for driving a rotary shaft, an annular toothed section being formed on the circumference of the rotary shaft; a rotary disc rotatably disposed around the main body; a bracket disposed under the bottom face of the main body and drivable by the rotary disc; a support tray disposed under the bracket, several rail channels being radially formed on the support tray at equal intervals; and a predetermined number of detent members respectively slidably disposed in the rail channels. When turning the rotary disc, the detent members are moved along the rail channels and contracted or expanded to make the arched toothed sections of inner ends of the detent members engage with or disengage from the annular toothed section of the rotary shaft.

14 Claims, 9 Drawing Sheets

GRINDER WITH EASILY INSTALLABLE/ DETACHABLE GRINDING DISC

BACKGROUND OF THE INVENTION

The present invention is related to a grinder, and more particularly to a grinder in which the rotary shaft can be fixed without using any tool for replacing the grinding disc.

A conventional pneumatic or electric grinder has a grinding disc mounted at bottom end for grinding or buffering a work piece. When grinding different work pieces, it is necessary to frequently replace the grinding disc.

In the conventional grinding structure, an eccentric rotary shaft is disposed at bottom end of the rotor (pneumatic grinder) or the motor (electric grinder). A hexagonal nut is fixed at bottom end of the rotary shaft. A worm is disposed at the center of the top face of the grinding disc. The worm is screwed in the nut, whereby the grinding disc is drivable by the rotary shaft. In addition, a protective sheath is disposed at bottom end of the grinder for covering the grinding disc and providing a protective effect.

The conventional grinder is equipped with a flat wrench. When replacing the grinding disc, the wrench is extended through the gap between the protective sheath and the grinding disc to fit onto the nut and prevent the rotary shaft from rotating. Under such circumstance, the grinding disc can be untightened or tightened. Such procedure is quite inconvenient, for the protective sheath obstructs the operator from seeing the nut. Therefore, it is hard for the operator to fit the wrench onto the nut. Moreover, the rotary shaft is eccentrically arranged and has unfixed position so that the operator often needs to try many times for wrenching the nut.

Furthermore, in case there is no tool available, it will be impossible to replace the grinding disc.

SUMMARY OF THE INVENTION

It is therefore a primary object of the present invention to provide a grinder in which a structure is provided for fixing the rotary shaft, whereby the grinding disc can be replaced without using any tool.

The present invention can be best understood through the following description and accompanying drawings wherein:

DETAILED DESCRIPTION OF THE PREFERRED EMBODIMENTS

Figure 1:
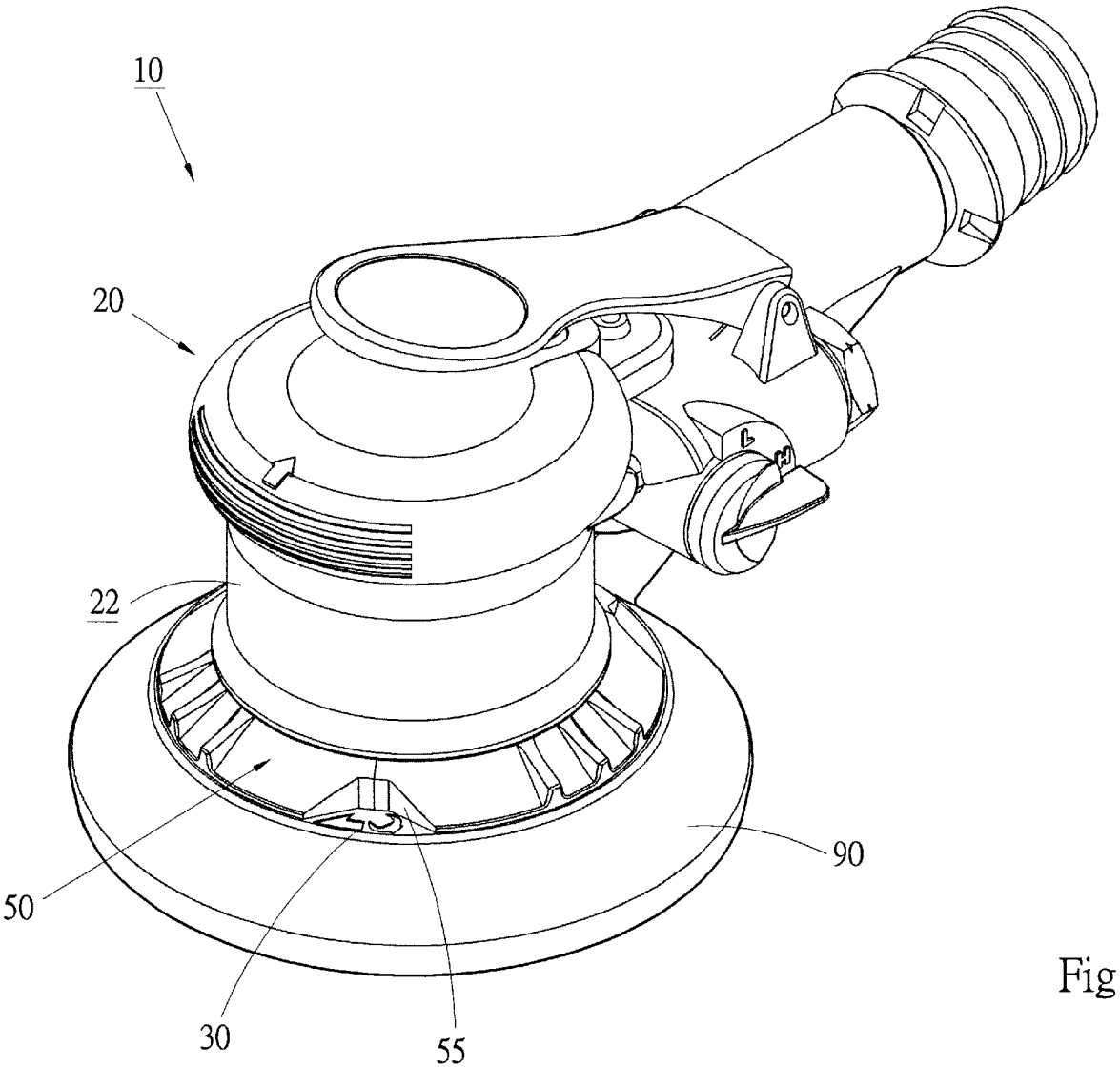
FIG. 1 is a perspective assembled view of a preferred embodiment of the present invention.
Figure 2:
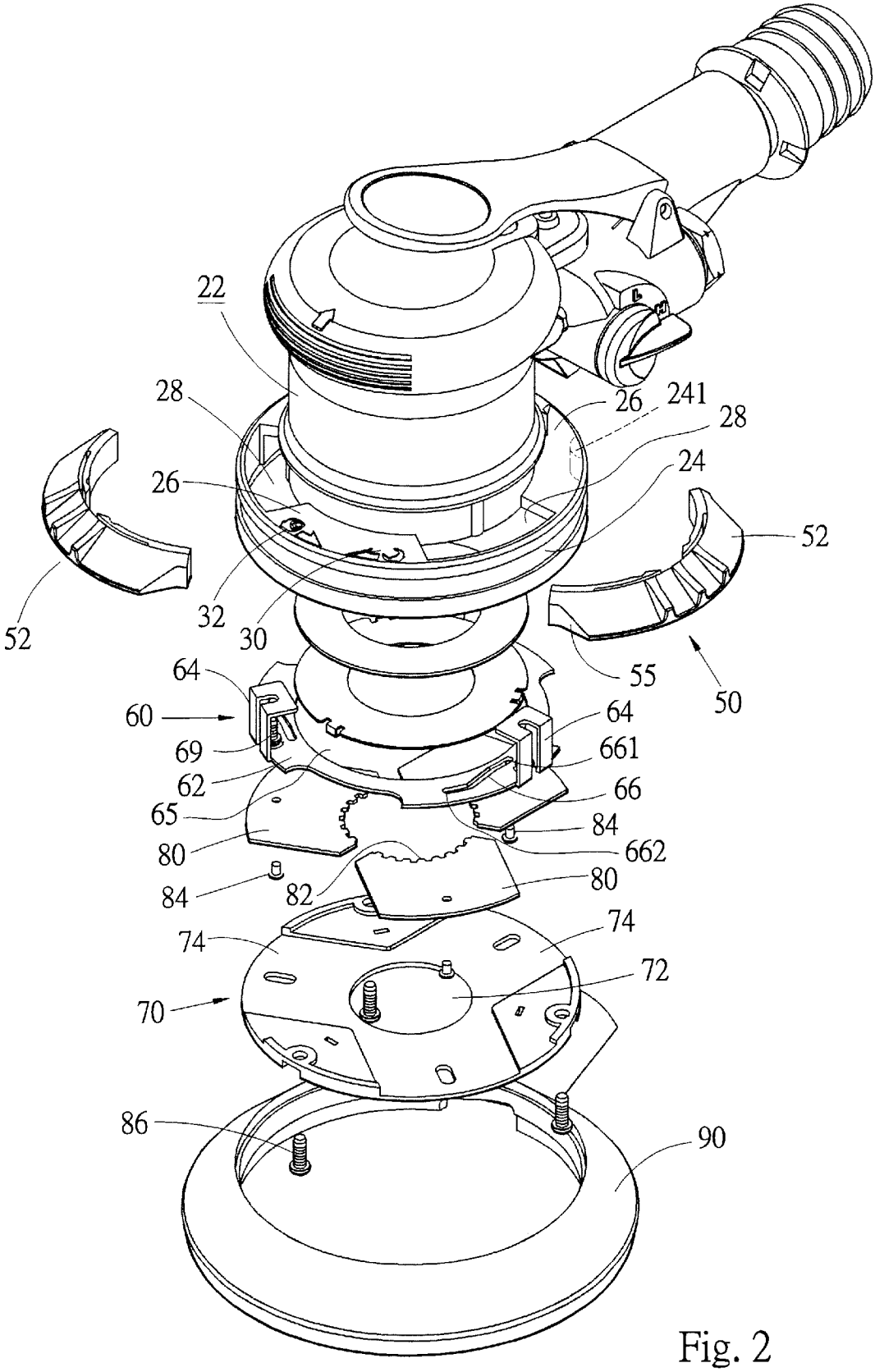
FIG. 2 is a perspective exploded view according to FIG. 1.

Please refer to FIGS. 1 and 2. According to a preferred embodiment, the grinder 10 of the present invention includes a main body 20, a rotary shaft 40, a rotary disc 50, a bracket 60, a support tray 70 and detent members 80.

Figure 3:
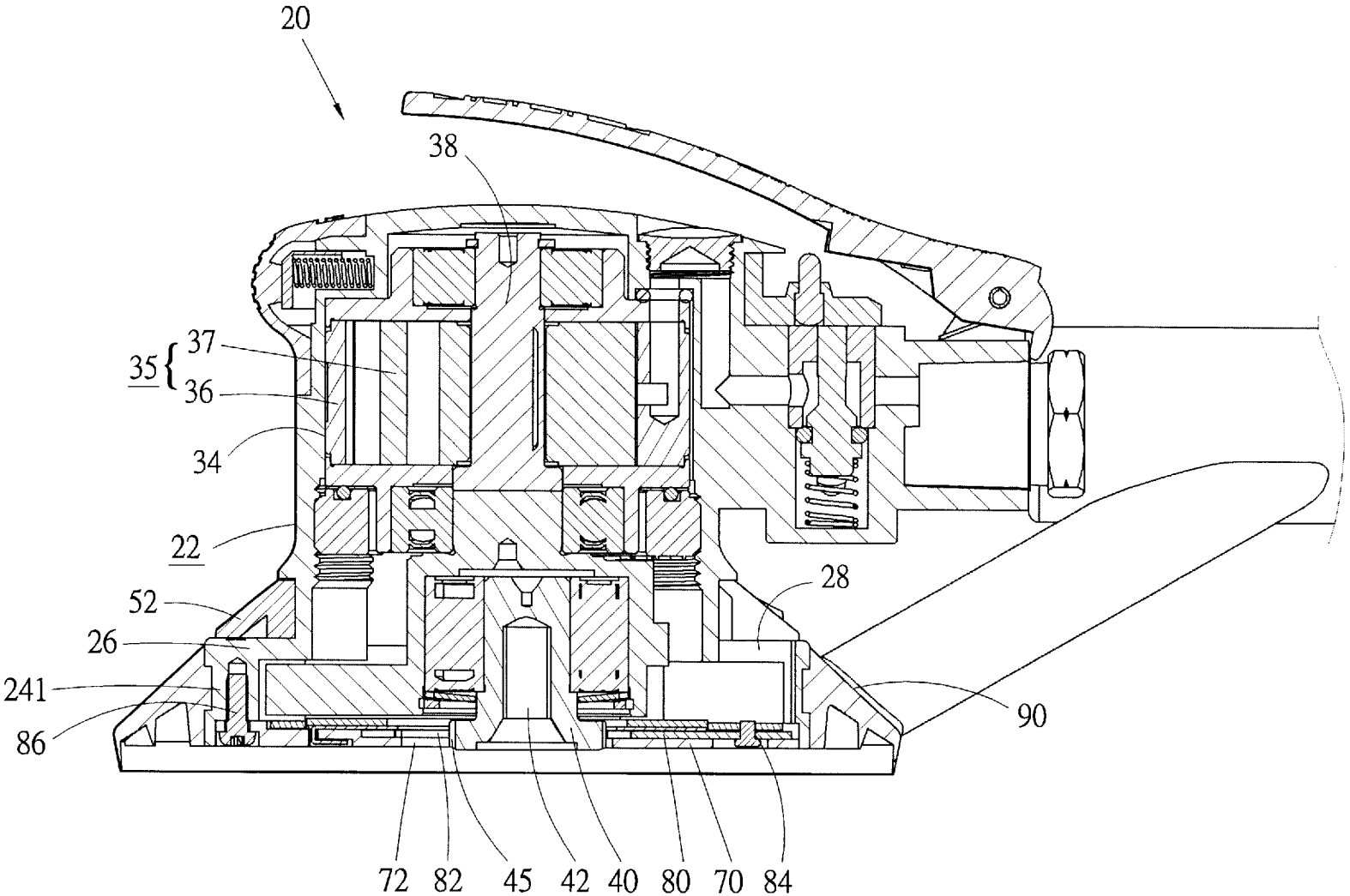
FIG. 3 is a longitudinal sectional view according to FIG. 1.

The main body 20 has a barrel section 22. At least the bottom end of the barrel section is circular. The main body also has a circular loop section 24 having a diameter larger than that of the barrel section 22 and positioned at bottom end of the barrel section. The inner circumference of the loop section has three connecting sections 26 arranged at equal intervals and connected between the barrel section 22 and the loop section 24. The three connecting sections define three hollow sections 28 at equal intervals. In addition, two figure marks 30, 32 are disposed on top face of one of the connecting sections. Referring to FIG. 3, a space 34 is formed in the barrel section 22 in which a driving unit 35 is accommodated. In this embodiment, the grinder is a pneumatic grinder, the driving unit 35 is a pneumatic cylinder 36 in which a rotor 37 is disposed.

Figure 4:
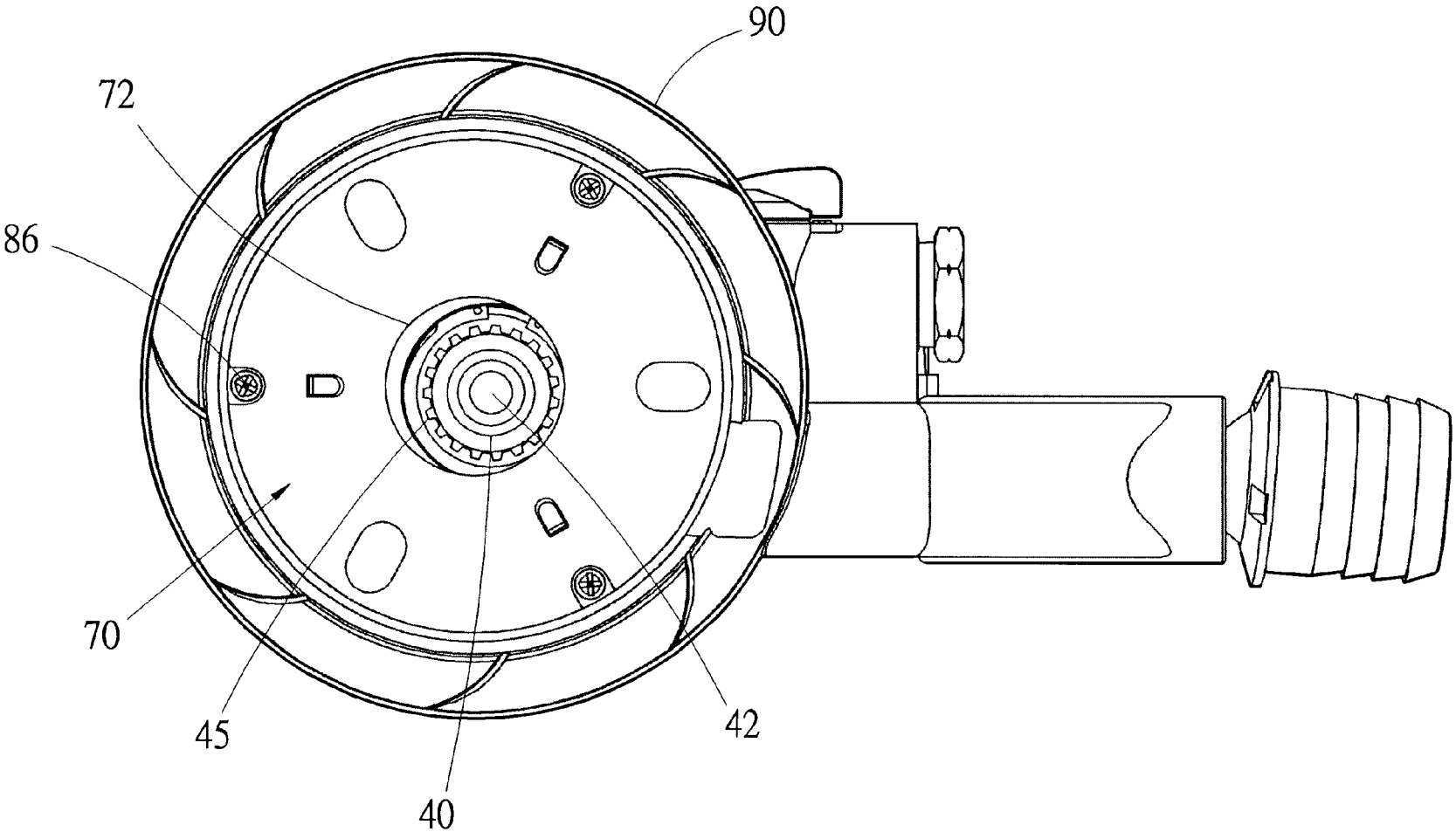
FIG. 4 is a bottom view according to FIG. 1.

The rotary shaft 40 is eccentrically pivotally connected with bottom end of the driving unit 35 and is driven by the driving shaft 38 of the driving unit. The rotary shaft is eccentrically arranged so as to provide a vibration effect. The bottom end of the rotary shaft 40 is formed with an axial thread hole 42. In addition, an annular toothed section 45 is formed along the circumference of the bottom end of the rotary shaft as shown in FIG. 4.

The rotary disc 50, referring to FIGS. 1 and 2, in this embodiment, is composed of three arched bodies 52 having equal arch length (120 degrees). The three arched bodies 52 are annularly arranged around the loop section 24 to shield the top face of the connecting sections 26.

Figure 5:
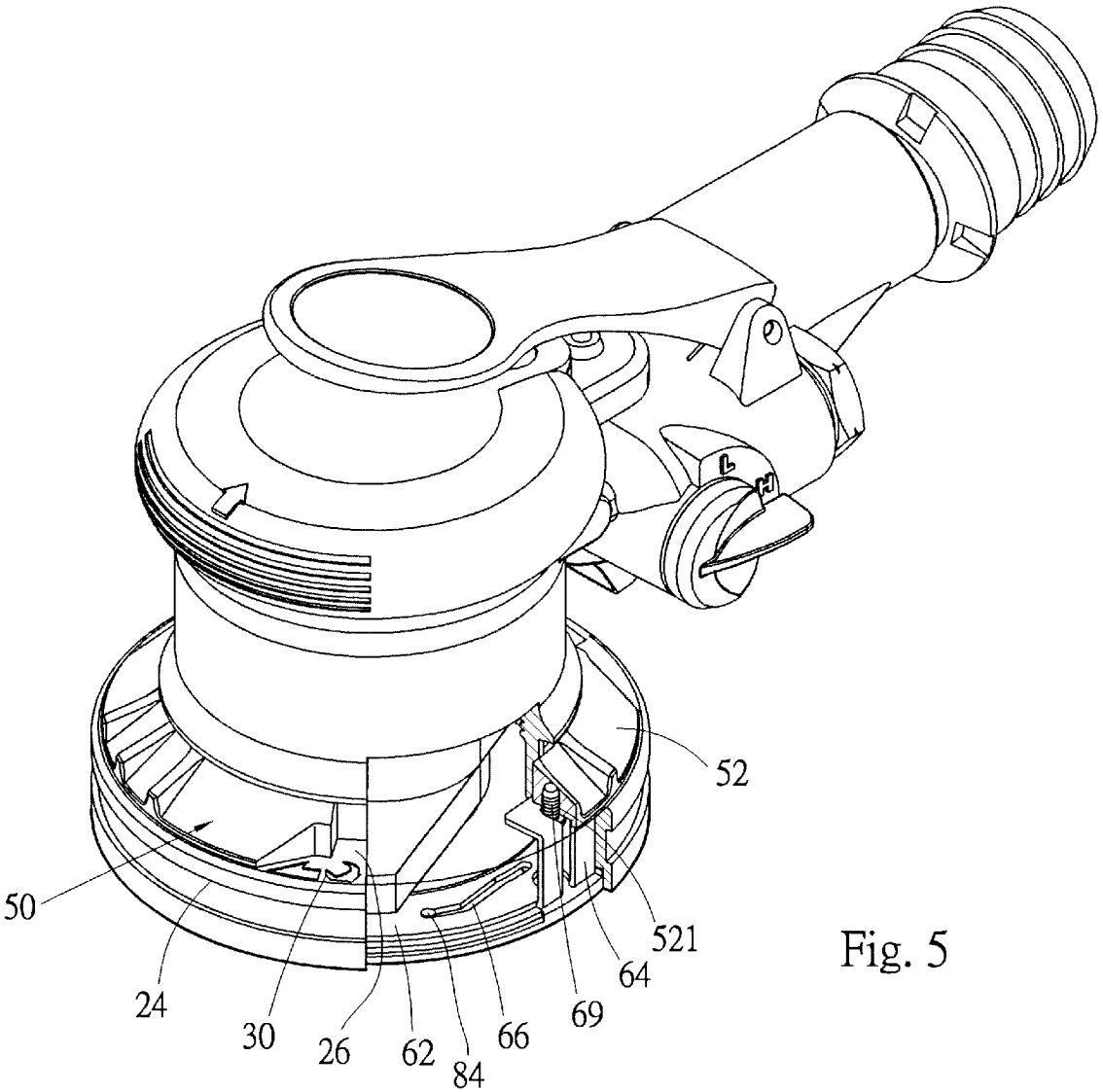
FIG. 5 is a partially sectional view according to FIG. 1.

The bracket 60 has a disc-like body section 62 and three legs 64 arranged on the circumference of the body section at equal intervals. In addition, the body section 62 is formed with a central through hole 65 and three oblique guide slots 66 at equal intervals. Each guide slot has an inner end 661 and an outer end 662. In radial direction, the inner end 661 is closer to the center of the body section 62, while the outer end 662 is farther from the center of the body section. The bracket 60 is mounted in the loop section 24 with the three legs 64 respectively extending through the three hollow sections 28. Each leg is fixed at a pivot hole 521 of the arched body 52 by a screw 69 as shown in FIG. 5. The three arched bodies 52 are respectively fixed with the three legs so that the arched bodies keep having a circular configuration without departing from each other. When rotating the rotary disc 50 on the loop section 24, the bracket 60 is driven and moved. The legs 64 and the guide slots 66 are concentric with the body section 62 and the body section is concentric with the driving shaft 38 of the driving unit 35.

The support tray 70 is formed with a central circular hole 72. Three rail channels 74 are radially formed on the top face of the support tray 70 at equal angular intervals.

Three plate-like detent members 80 respectively disposed in the three rail channels 74 and slidable along the rail channels. An inner end of each detent member 80 is formed with an arched toothed section 82 having several teeth. The three arched toothed sections 82 form a circular configuration. The pitch between the teeth of the toothed section 82 is equal to the pitch between the teeth of the annular toothed section 45 of the rotary shaft 40. Three guide posts 84 are respectively fixed with the three detent members 80.

Figure 6:
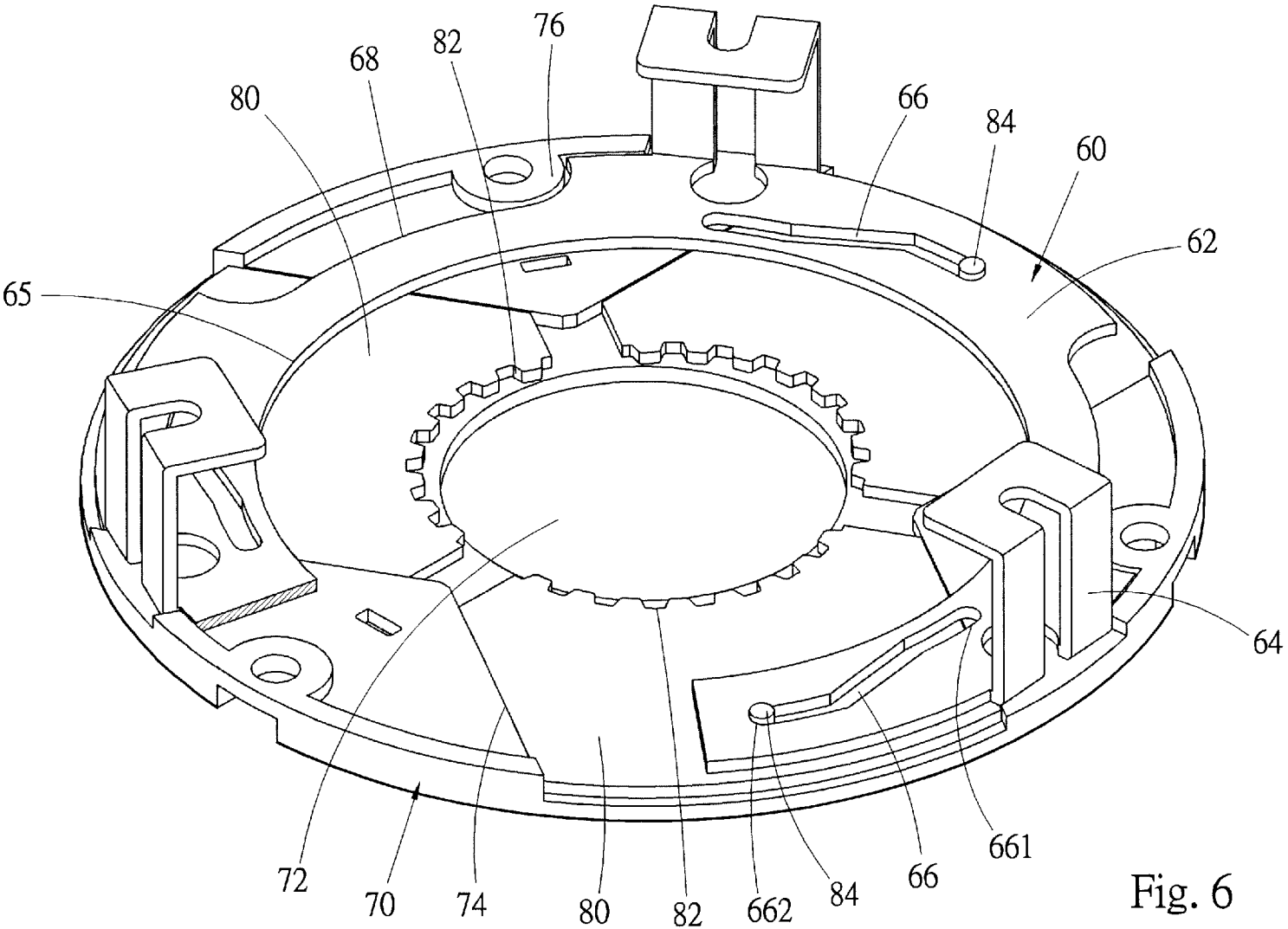
FIG. 6 is a perspective assembled view of the support tray, bracket and detent members of the present invention.

After the detent members 80 are mounted into the support tray 70, the support tray is fixedly connected with small projections 241 formed on inner circumference of the loop section 24 by three screws 86 as shown in FIGS. 2 and 3. Accordingly, the support tray is fixed in the loop section. The support tray and the detent members right attach to the bottom face of the body section 62 of the bracket 60. Referring to FIG. 6, the three guide posts 84 are fitted in the guide slots 66. The support tray 60 is concentric with the bracket 70.

After the components 60, 70, 80 are mounted in the loop section 24, as shown in FIG. 3, the annular toothed section 45 of the bottom end of the rotary shaft 40 extends into the bracket and the circular hole 72 of the support tray.

A hollow protective sheath 90 made of hard plastic or rubber material is fitted around the loop section 24 to provide a protective effect.

Figure 7:
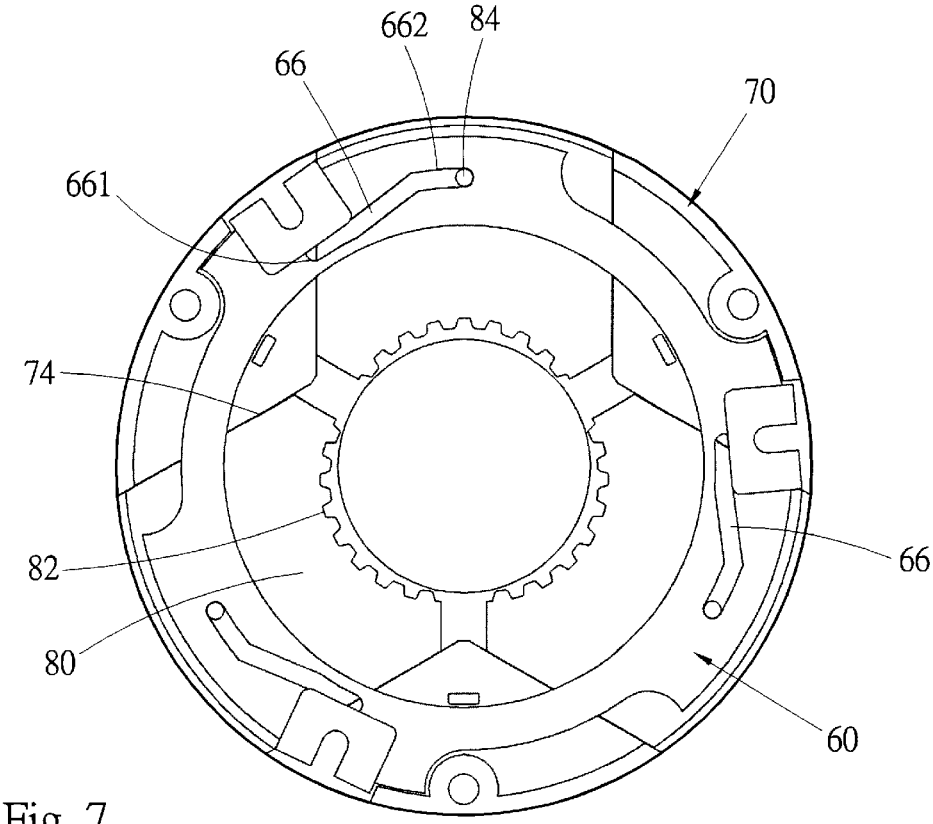
FIG. 7 is a top view according to FIG. 6, showing that the detent members are opened.

FIG. 1 is a perspective assembled view of the present invention, in which the rotary disc 50 has at least one window 55 (which is inward recessed in this embodiment). The window 55 corresponds to the connecting section 26 having the two marks 30, 32. In FIG. 1, the window 55 is right positioned at the mark 30 which is a figure of a wrench. Under such circumstance, the rotary disc 50 is positioned in an opened position. In this position, as shown in FIG. 7, the guide posts 84 are positioned at outer ends 662 of the guide slots 66 and the three detent members 80 are expanded outward. In this state, referring to FIG. 4, the rotary shaft 40 is not restricted and can freely rotate. After activating the grinder, the rotary shaft can drive the grinding disc (not shown) to grind a work piece.

Figure 8:
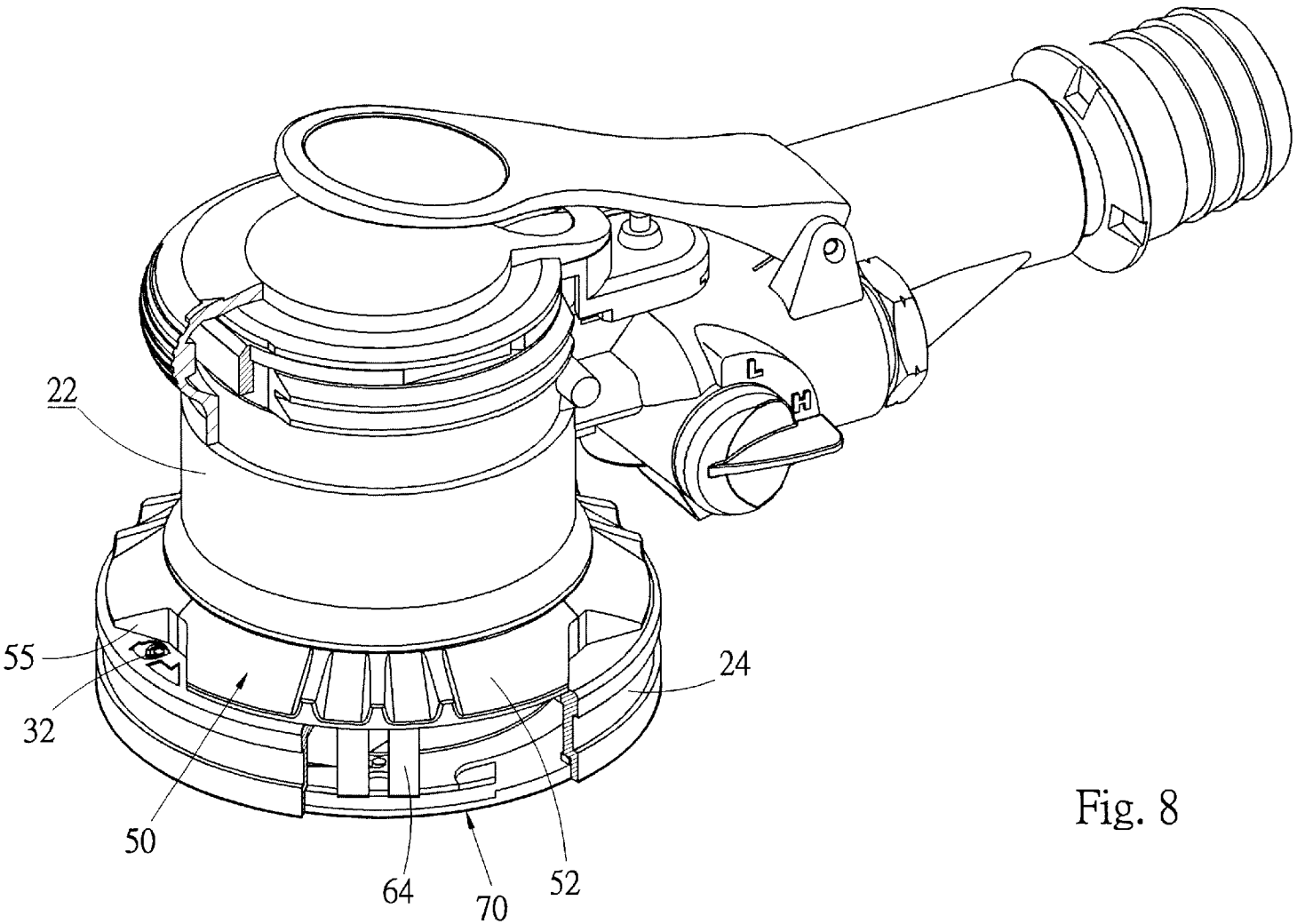
FIG. 8 shows that the rotary disc of the present invention is turned to another position.

When replacing the grinding disc, the operator clockwise turns the rotary disc 50 to a closed position as shown in FIG. 8, in which the other mark 32 is exposed through the window 55. The mark 32 is a figure showing that a wrench is fitted onto a nut to indicate the operator of the restriction of the rotary shaft.

Figure 9:
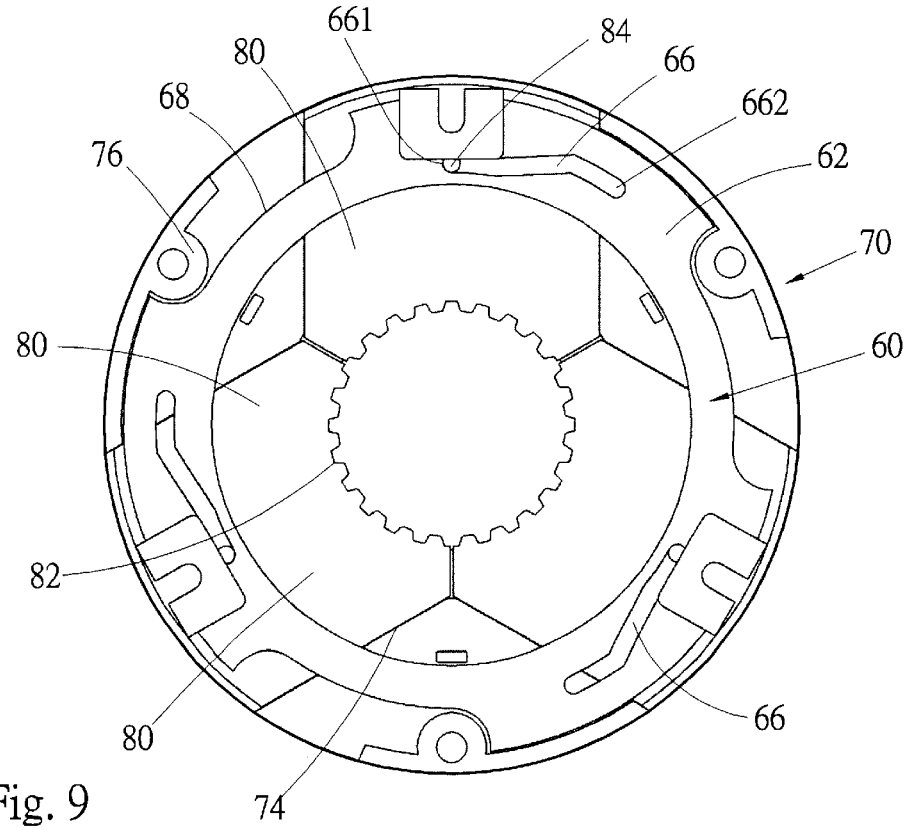
FIG. 9 is a top view according to FIG. 8, showing that the detent members are closed.

Referring to FIG. 8, when the rotary disc 50 is clockwise angularly displaced, the bracket 60 is synchronously rotated. At this time, the angular positions of the three guide slots 66 are changed and the guide posts 84 are moved from the outer ends 662 of the guide slots to the inner ends 661 thereof as shown in FIG. 9. When the guide posts 84 are displaced, the detent members 80 are driven by the guide posts to inward slide along the rail channels 74 to a closed position, the three detent members contract and the arched toothed sections 82 thereof are closed into a complete circle.

Figure 10:
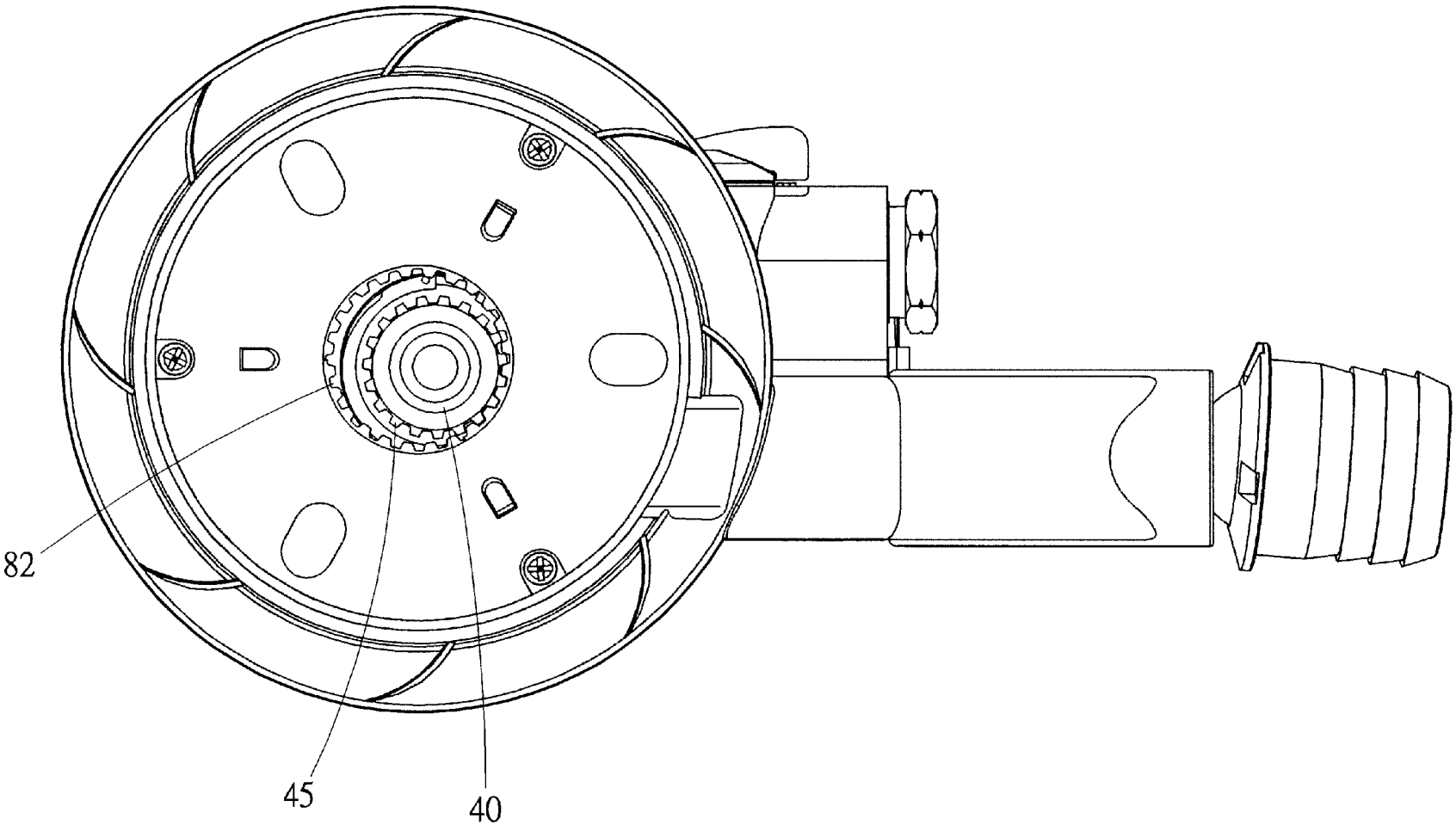
FIG. 10 is a bottom view of the present invention in the state of FIG. 9.

Under such circumstance, referring to FIG. 10, the arched toothed sections 82 of the detent members are engaged with the annular toothed section 45 of the rotary shaft 40 to fix and prevent the rotary shaft from rotating. An operator can screw the worm of the grinding disc into the thread hole 42 of the rotary shaft or unscrew the worm out of the thread hole so as to replace the grinding disc.

It should be noted that when the three detent members 80 are closed, the three arched toothed sections 82 form a circle having a circumferential length equal to the circumferential length of the circle defined by the eccentric rotation of the rotary shaft 40. Therefore, after the grinder stops operating, no matter in what angular position the rotary shaft stops, the rotary shaft is clamped and fixed by the detent members.

When activating the grinder, the rotary disc 50 is counterclockwise turned back to the opened position as shown in FIG. 1 to move the guide posts 84 to the outer ends of the guide slots. At this time, the detent members are restored to the expanded state as shown in FIG. 7 and disengaged from the rotary shaft.

In addition, three locating sections 76 can be disposed on the support tray at equal intervals as shown in FIG. 9. Three dents 68 are disposed on the body section 62 of the bracket at equal intervals. Two sides of the dent 68 abut against the locating section 76 to serve as the dead end of the movement of the rotary disc and the bracket.

By means of simple operation, the rotary shaft can be fixed or released for replacing the grinding disc without using any tool. This is convenient and facilitates the operation.

The marks 30, 32 enable an operator to judge whether the rotary shaft is freely rotatable or fixed.

Alternatively, the guide slots 66 and the guide posts 84 can be switched in position, that is, the guide slots are formed on the detent members, while the guide posts are disposed under the bottom face of the body section of the bracket at equal intervals. This can achieve the same effect.

The above embodiment is only used to illustrate the present invention, not intended to limit the scope thereof.

What is claimed is:

1. A grinder with easily installable/detachable grinding disc, comprising:

a main body having a circular loop section at bottom end of the main body, a driving unit being disposed in the main body;

a rotary shaft pivotally connected with bottom end of the driving unit and drivable by the driving unit; an annular toothed section being formed on a circumference of bottom end of the rotary shaft;

a rotary disc rotatably disposed around the loop section;

a bracket having a hollow circular body section, at least two oblique guide slots being concentrically formed on the body section at equal intervals, each guide slot having an inner end and an outer end, the inner end being closer to the center of the body section than the outer end and a position difference existing between the inner end and outer end, the bracket being mounted in the loop section and connected with the rotary disc and drivable by the rotary disc;

a hollow support tray, at least two rail channels being radially formed on the support tray at equal angular intervals; and detent members the number of which is equal to the number of the rail channels, the detent members being respectively disposed in the rail channels and slidable along the rail channels, an inner end of each detent member being formed with an arched toothed section, the arched toothed sections together forming a circular configuration; guide posts the number of which is equal to the number of the detent members being respectively fixed with the detent members;

the support tray being fixed in the loop section, the support tray and the detent members being under the body section of the bracket, the guide posts being fitted in the guide slots, the support tray being concentric with the bracket;

the annular toothed section of the rotary shaft extending into the hollow portions of the bracket and the support tray;

whereby when turning the rotary disc to drive the bracket to angularly displace, the detent members being contracted or expanded to make the arched toothed sections engage with or disengage from the annular toothed section of the rotary shaft.

2. The grinder as claimed in claim 1, wherein the circular loop section has a diameter larger than that of the bottom end of the main body, at least two connecting sections being connected between the main body and the loop section at equal intervals, the connecting sections defining therebetween hollow sections the number of which is equal to the number of the connecting sections, the bracket being connected with the rotary disc through the hollow sections.

3. The grinder as claimed in claim 2, wherein the rotary disc is composed of at least two arched bodies having predetermined arch length.

4. The grinder as claimed in claim 2, wherein two figure marks are disposed on top face of at least one of the connecting sections; the rotary disc having at least one window corresponding to the position of the marks, whereby when the rotary disc is angularly displaced to different positions, the marks are exposed through the window.

5. The grinder as claimed in claim 2, wherein a predetermined number of legs are disposed on top face of the body section of the bracket at equal intervals, the bracket via the legs being connected with the rotary disc.

6. The grinder as claimed in claim 1, wherein the rotary shaft is eccentrically connected with the driving unit, whereby when the detent members are contracted, the circle formed by the arched toothed sections is tangential to the circle defined by the eccentric rotation of the rotary shaft.

7. The grinder as claimed in claim 1, wherein at least one locating section is disposed on the top face of the support tray, at least one dent being disposed on the body section of the bracket, the locating section being located in the dent.

8. A grinder with easily installable/detachable grinding disc, comprising:

a main body having a circular loop section at bottom end of the main body, a driving unit being disposed in the main body;

a rotary shaft pivotally connected with bottom end of the driving unit and drivable by the driving unit, an annular toothed section being formed on a circumference of bottom end of the rotary shaft;

a rotary disc rotatably disposed around the loop section;

a bracket having a hollow circular body section, at least two guide posts being concentrically disposed under the bottom face of the body section at equal intervals, the bracket being mounted in the loop section and connected with the rotary disc and drivable by the rotary disc;

a hollow support tray, at least two rail channels being radially formed on the support tray at equal angular intervals; and detent members the number of which is equal to the number of the rail channels, the detent members being respectively disposed in the rail channels and slidable along the rail channels, an inner end of each detent member being formed with an arched toothed section, the arched toothed sections together forming a circular configuration; oblique guide slots the number of which is equal to the number of the detent members being respectively concentrically formed on the detent members, each guide slot having an inner end and an outer end, the inner end being closer to the inner end of the detent member than the outer end and a position difference existing between the inner end and outer end of the guide slot;

the support tray being fixed in the loop section, the support tray and the detent members being under the body section of the bracket, the guide posts being fitted in the guide slots, the support tray being concentric with the bracket;

the annular toothed section of the rotary shaft extending into the hollow portions of the bracket and the support tray;

whereby when turning the rotary disc to drive the bracket to angularly displace, the detent members being contracted or expanded to make the arched toothed sections engage with or disengage from the annular toothed section of the rotary shaft.

9. The grinder as claimed in claim 8, wherein the circular loop section has a diameter larger than that of the bottom end of the main body, at least two connecting sections being connected between the main body and the loop section at equal intervals, the connecting sections defining therebetween hollow sections the number of which is equal to the number of the connecting sections, the bracket being connected with the rotary disc through the hollow sections.

10. The grinder as claimed in claim 9, wherein the rotary disc is composed of at least two arched bodies having predetermined arch length.

11. The grinder as claimed in claim 9, wherein two figure marks are disposed on top face of at least one of the connecting sections; the rotary disc having at least one window corresponding to the position of the marks, whereby when the rotary disc is angularly displaced to different positions, the marks are exposed through the window.

12. The grinder as claimed in claim 9, wherein a predetermined number of legs are disposed on top face of the body section of the bracket at equal intervals, the bracket via the legs being connected with the rotary disc.

13. The grinder as claimed in claim 8, wherein the rotary shaft is eccentrically connected with the driving unit, whereby when the detent members are contracted, the circle formed by the arched toothed sections is tangential to the circle defined by the eccentric rotation of the rotary shaft.

14. The grinder as claimed in claim 8, wherein at least one locating section is disposed on the top face of the support tray, at least one dent being disposed on the body section of the bracket, the locating section being located in the dent.

* * * * *